United States Patent [19]

Lardellier

[11] Patent Number: 4,714,404

[45] Date of Patent: Dec. 22, 1987

[54] APPARATUS FOR CONTROLLING RADIAL CLEARANCE BETWEEN A ROTOR AND A STATOR OF A TUBROJET ENGINE COMPRESSOR

[75] Inventor: Alain M. J. Lardellier, Melun, France

[73] Assignee: Societe Nationale d'Etudes et de Construction de Moteurs O'Aviation (S.N.E.C.M.A.), France

[21] Appl. No.: 942,987

[22] Filed: Dec. 17, 1986

[30] Foreign Application Priority Data

Dec. 18, 1985 [FR] France ..... 85 18749

[51] Int. Cl.[4] ..... F01D 11/08

[52] U.S. Cl. ..... 415/127; 415/171

[58] Field of Search ..... 415/171, 127, 174, 129, 415/170 R, 133, 128

[56] References Cited

U.S. PATENT DOCUMENTS

| | | | |
|---|---|---|---|
| 3,085,398 | 4/1963 | Ingleson . | |
| 4,127,357 | 11/1978 | Patterson . | |
| 4,330,234 | 5/1982 | Colley | 415/171 |
| 4,543,039 | 9/1985 | Ruis et al. . | |

FOREIGN PATENT DOCUMENTS

| | | |
|---|---|---|
| 2534982 | 10/1982 | France . |
| 2068470 | 8/1981 | United Kingdom . |
| 2099515 | 12/1982 | United Kingdom . |
| 2108591 | 5/1983 | United Kingdom . |

*Primary Examiner*—Henry A. Bennet

*Attorney, Agent, or Firm*—Bacon and Thomas

[57] ABSTRACT

An apparatus for controlling the radial clearance between a rotor and a stator of a high pressure compressor for a turbojet engine is disclosed wherein a plurality of segments which define an inner casing are attached to an outer casing so as to be radially movable. A parallelogram linkage interconnects each of the segments to the outer casing such that rotation of a control shaft causes the radial movement of the individual segments.

12 Claims, 2 Drawing Figures

APPARATUS FOR CONTROLLING RADIAL CLEARANCE BETWEEN A ROTOR AND A STATOR OF A TUBROJET ENGINE COMPRESSOR

BACKGROUND OF THE INVENTION

Advanced turbojet engines now operate at temperatures of approximately 700° C. at the outlet of the high pressure compressor. The high temperatures make it mandatory to provide some means for optimizing the clearance between the rotor and the stator of the high pressure compressor in order to compensate for the differential thermal expansion between these elements. The clearance between the rotor and the stator is typically maintained at a minimum in order to maximize the efficiency of the compressor. However, due to the high operating temperatures, some means must be provided to compensate for the differential thermal expansion.

The compensation devices set forth in U.S. Pat. No. 4,543,039 to Ruis et al and French Pat. No. 2,534,982 consists of supports to attach segments defining an inner casing of the compressor to the outer casing of the compressor. The radial clearance between the rotor blades and the sealing rings of the stator, and between the stator vanes and the rotor seals is controlled by directing a flow of hot or cold air against the supports and/or against the outer casing. These devices are effective if the coefficient of thermal expansion of the support material or of the outer casing is sufficiently large to enable it to respond to temperature changes in the injected air. However, this is typically not the case, and these devices have not completely obviated the clearance problem. Also, these devices suffer the drawback of increased loss of air due to the changing geometry of the support caused by the heat exchange with an air flow.

Mechanical regulators are also known, as illustrated in British Pat. Nos. 2,068,470 and 2,108,591. In these systems, the sealing rings for the rotor blades are provided on the stator, which consists of a plurality of segments circumferentially arranged about the rotor wheel. The segments have cooperating slots and tongues defined on their edges to provide for the required sealing and to allow the segments to move. In U.S. Pat. No. 2,068,470 to segments are circumferentially moved by a gear drive mechanism and, due to the interengagement of projections and a cam track, this circumferential movement also causes the segments to move radially. In an alternative embodiment, the segments are caused to circumferentially move via a pair of link rods extending from a drive ring.

In U.S. Pat. No. 2,108,591 the sealing segments are fixed to one end of a bell crank arm, the opposite end of which is drivingly connected to a control bar. The control bar, which may drive three or more bell cranks, is driven by an actuating cylinder having an expandable and contractible piston rod. Thus, through the bell crank arms, the circumferential displacement of the control bars causes the bell cranks to pivot, thereby imparting a radial displacement to the sealing segments.

These devices are typically mounted between two casings forming the housing surrounding the compressor which entail forming many openings which could possibly lead to substantial leaks. In addition, these devices are mechanically complex which inherently reduces their reliability and increases the risk of malfunction.

SUMMARY OF THE INVENTION

The present invention relates to an apparatus for controlling the radial clearance between the rotor and the stator of a high pressure, turbojet engine compressor. The apparatus comprises a plurality of segments circumferentially arranged about the rotor wheel so as to form an inner casing and to which the stator vanes are mounted. The individual segments are attached to an outer casing via a pair of upstream links and a pair of downstream links, each of which form a parallelogram linkage. A control shaft, is rotatably attached to the outer shell such that it extends generally parallel to the longitudinal axis of the compressor. Each end of the shaft is drivingly connected to one of the link members via a spline connection, such that rotation of the control shaft also causes these links to rotate. Such rotation, due to the parallelogram linkage, causes the individual segments to move radially with respect to the rotor wheel.

The control means, which may include an actuating cylinder having an extendable and contractible piston rod drivingly connected to the control shaft is located externally of the outer casing so as to be readily accessible. Individual actuating cylinders may be provided for each segment, or a single actuating cylinder may be provided and connected to all of the segments via a synchronizing ring.

DETAILED DESCRIPTION OF THE PREFERRED EMBODIMENT

Figure 1:
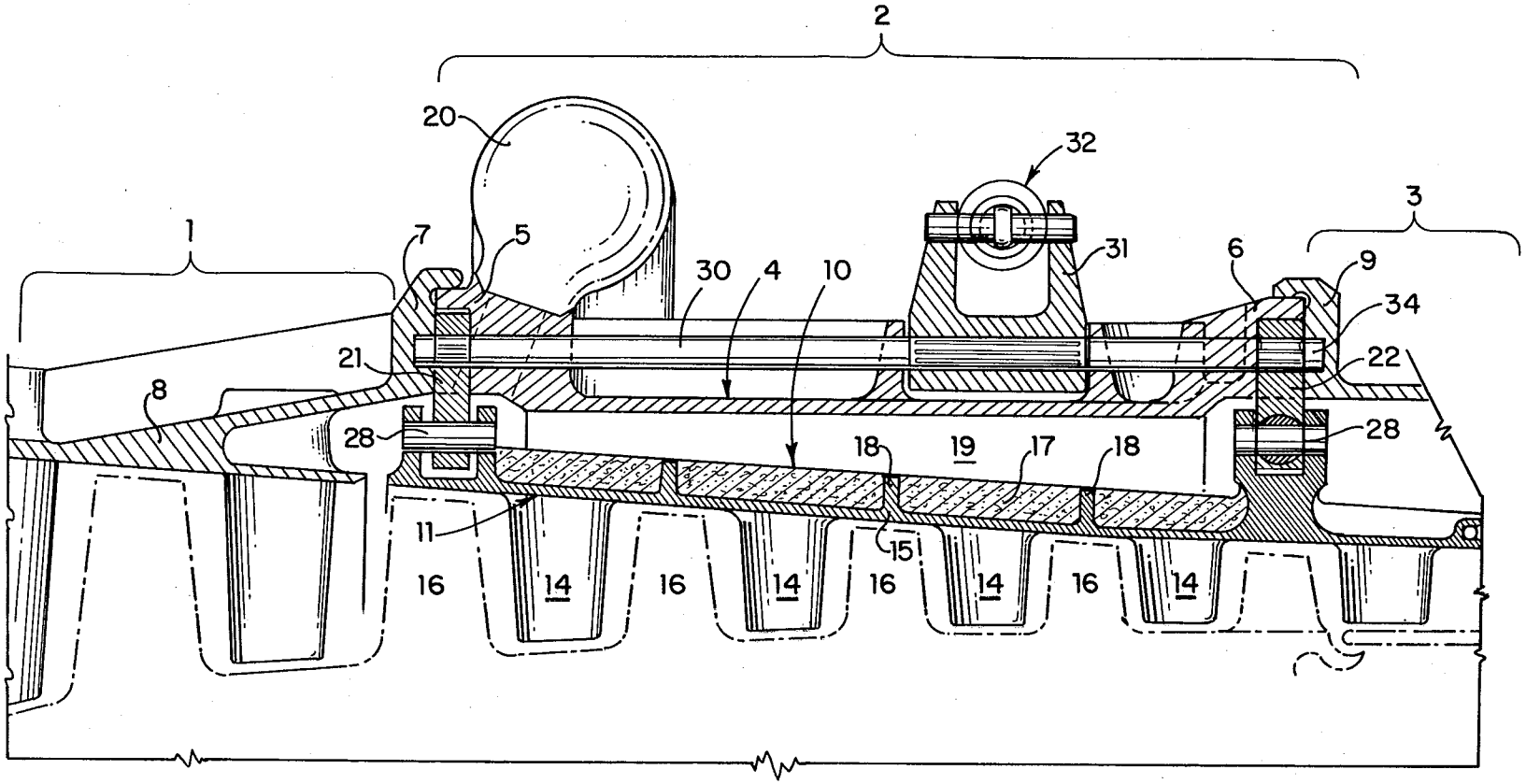
FIG. 1 is a partial, longitudinal sectional view of a turbojet engine compressor showing the control apparatus according to the invention.

FIG. 1 shows a partial, longitudinal sectional view of a turbojet engine having a low pressure compressor 1, a high pressure compressor 2 and a diffuser 3. The high pressure compressor 2 is made up of a substantially cylindrical outer casing 4 which is provided at its upstream and downstream ends with flanges 5 and 6, respectively. These flanges are attached, at the upstream side, to a complementary flange 7 formed on casing 8 of the low pressure compressor 1, and at the downstream end to a flange 9 formed on the casing of the diffuser 3.

Compressor 2 also includes an inner casing 10 having means to regulate and control the radial clearance between it and the rotor wheel having rotor blades 16. The inner casing 10 has six frusto-conical segments 11 arranged circumferentially adjacent each other so as to form the inner casing 10 generally concentric with the compressor's longitudinal axis. Each of the segments 11 is fabricated from a material having a relatively low coefficient of thermal expansion. The adjacent longitudinal edges of the segments 11 have channels 12 formed therein to accommodate sliding seals 13. The seals prevent leakage of the compressor air between the segments, while at the same time allow the mutual circumferential and radial displacement of the segments 11. Stator vanes 14 are mounted on the inner surface of the segments 11 and have known sealing rings 15 closely located therebetween. The sealing rings 15 cooperate with the ends of rotor blades 16 to minimize the leakage of air within the compressor. Sealing rings 15 may be formed from an abrading material, as is well known in the art.

The outer surface of inner casing 10 may be equipped with a heat shield 17 to minimize the heat transfer from the compressor. Heat shield 17 may be located between transverse reinforcing ribs 18 as shown in FIG. 1.

Outer casing 4 and inner casing 10 define a space 19 therebetween which may be cooled by a flow of air trapped from an outlet of the low pressure compressor 1. A low pressure air reservoir 20 is provided at the upstream end of the outer casing 4 to feed and cool the various components of the turbojet engine in known fashion.

Figure 2:
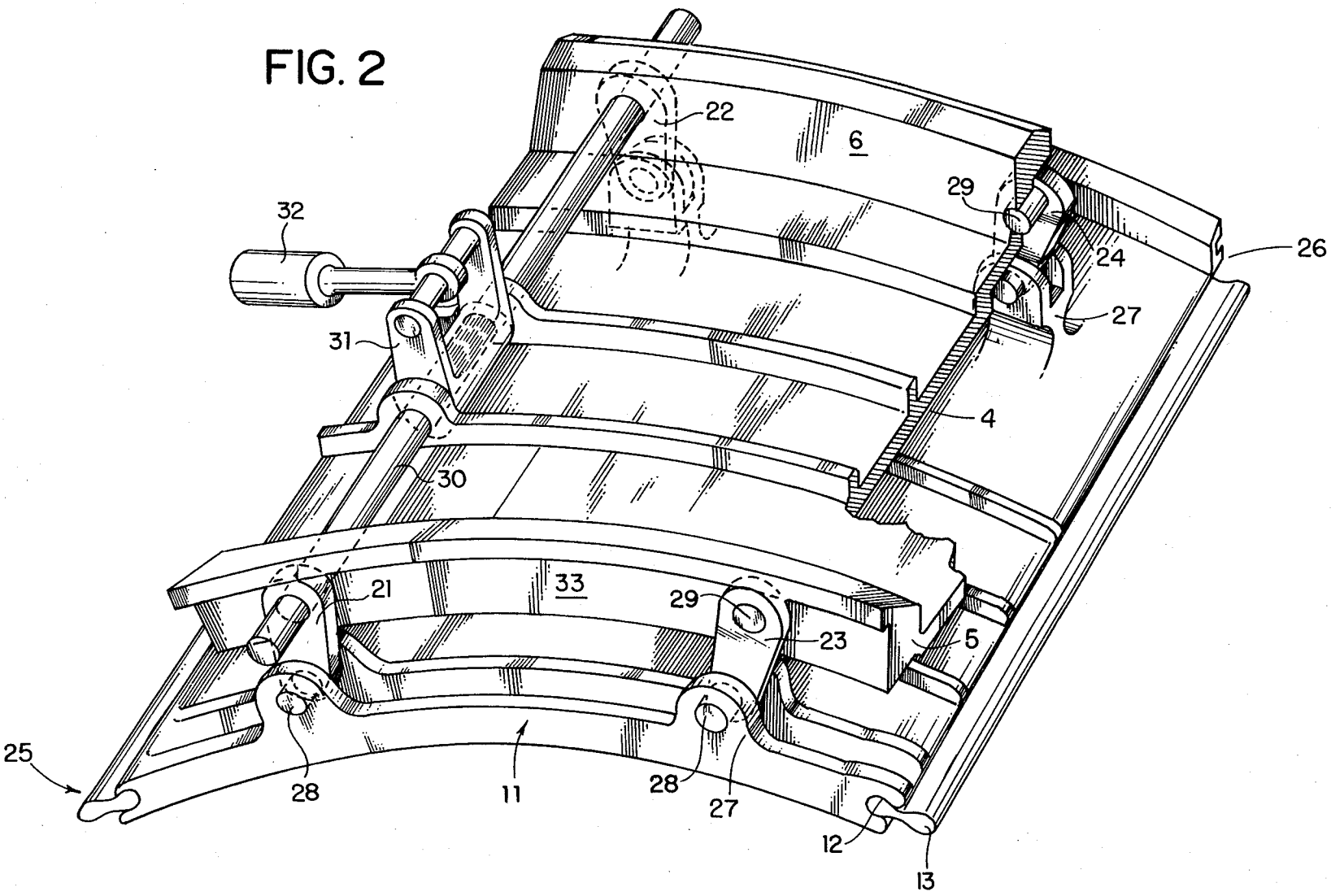
FIG. 2 is a partial, perspective view of the apparatus according to the invention.

The apparatus for controlling the movement of the segments 11 to control the clearance between the rotor and the stator comprises link members 21 through 24 which attach each of the segments 11 to the outer casing 4. The radially innermost ends of the link members are pivotally attached to the segment 11 by bosses 27 formed thereon and shaft 28 which extends through the ends of the link members and the bosses. The other ends of link members 23 and 24 are pivotally attached to flanges 5 and 6 of the outer casing 4 via shafts 29. Shafts 29 of upstream link 23 and downstream link 24 may be coaxial, as may shafts 28 of the upstream links 21 and 23 coaxial with those of downstream links 22 and 24. As shown in FIG. 2, link members 21 and 23 are attached adjacent the upstream edge 25 of segment 11, while link members 22 and 24 are located adjacent the downstream edge 26 thereof.

A control shaft 30 is rotatably attached to outer casing 4 so as to extend generally parallel to the longitudinal axis of the compressor. The upstream and downstream ends of the control shaft are attached to link members 21 and 22, respectively such that these members rotate with the control shaft 30. The attachment may take the form of splines, as shown, or any other connection means which will cause the link members to rotate with the control shaft. Lever mechanism 31 is also connected to control shaft 30 via a splined connection or the like. Actuating cylinder 32 having an expandable and contractible piston rod is attached to the lever 31 such that, as the piston rod extends or contracts, the control shaft 30 rotates about its longitudinal axis.

The radial sides of upstream flange 5 and downstream flange 6 define recesses 33 along a central portion to accommodate the link members 21–24. The recess 33 is shown in FIG. 2 on flange 5. The flanges 7 and 9 formed on the low pressure compressor and the diffuser, respectively, may define bearing means 34 to rotatably support the ends of control shaft 30 which project beyond the link members 21 and 22. The height of the flanges which serve to fasten the outer casing 4 to the low pressure compressor 1 and to the diffuser 3 are selected such that the control shaft 30 passes above the outer surface of the outer casing 4. As can be seen, the rotation of control shaft 30 will cause drive link members 21 and 22 to rotate. The force imparted on the segment 11 causes slave link members 23 and 24 to also rotate.

The links 21 and 23 form an upstream parallelogram linkage with the segment 11 and the flange 5, while links 22 and 24 form a downstream parallelogram linkage with the segment 11 and the flange 6. Links 21 and 23 extend generally parallel to each other, while links 22 and 24 extend parallel to each other. The upstream and downstream parallelogram linkages cause the segment 11 to move in a radial direction as the control shaft 30 is rotated. In the embodiment shown, rotating the link members through an angle 30° displaces the segment 11 approximately 1.5 mm in the radial direction so as to maintain the optimal clearance between the segments and the rotor blades. The link bar shafts 28 and 29 are located on mutually parallel cylinders, therefore the radial displacement of the upstream edge 25 and the downstream edge 26 of segments 11 are the same. However, this orientation may be varied by locating the link bar shafts 28 and 29 on a conical surface such that the upstream link members 21 and 23 may be different lengths than link members 22 and 24.

The invention encompasses having a plurality of actuating cylinders 32, preferably one for each segment 11. However, it also encompasses the concept wherein a single actuating cylinder 32 is provided and is connected to all of the segments via a synchronizing ring. The synchronizing ring is connected to all of the levers 31 of the individual segments and is moved in a circumferential direction by the actuating cylinder.

The actuating cylinders may be controlled by various operational parameters of the compressor, such as the operating mode, the temperature and/or the compressor outlet pressure. Known sensing means may be provided to sense one or more of the operational parameters and to generate an input signal. The input signals may be directed to an onboard computer which includes a program of the model of the engine's thermal behaviour and which, in conjunction with the input signals, may be utilized to control the actuating cylinders 32. Alternatively, the actuators can be driven in real time in relation to the clearance sensed by known sensors. The sensors may include capacitive sensors, contact sensors, accelerators, etc.

The foregoing description is provided for illustrative purposes only and should not be construed as in any way limiting the scope of the invention, which is defined solely by the claims appended hereto.

What is claimed is:

1. Apparatus for controlling the radial clearance between a rotor and a stator of a high-pressure compressor in a turbojet engine having a longitudinal axis and an outer casing surrounding the compressor, comprising:

(a) a plurality of circumferential segments having upstream and downstream edges arranged so as to form an inner casing located between the outer casing and the rotor so as to define a radial clearance with the rotor, each of the segments having a plurality of stator vanes mounted thereon;

(b) a control shaft rotatably attached to the outer casing and extending generally parallel to the longitudinal axis;

(c) upstream and downstream link means connecting each of the segments with the outer casing, each link means comprising:

(i) a first link member having a first end attached to the control shaft so as to rotate therewith and a second end pivotally attached to the segment; and, (ii) a second link member pivotally attached to the outer casing and to the segment such that the second link member extends generally parallel to the first link member so as to form a parallelogram with the outer casing and the segment; and, (d) control means connected to the control shaft so as to rotate the control shaft thereby moving the associated segment in a substantially radial direction so as to vary the clearance between the segment and the rotor.

2. The apparatus according to claim 1 further comprising:

(a) upstream and downstream flanges extending substantially radially from the outer casing, the flanges defining means to rotatably support the control shaft;

(b) first attachment means to pivotally attach first ends of the second link members to the upstream and downstream flanges, respectively, such that the second link members pivot abaout an axis extending substantially parallel to the control shaft; and (c) second attachment means to pivotally attach second ends of the first and second link members to the associated segment such that the link members pivot about a pair of axes extending substantially parallel to the control shaft.

3. The apparatus according to claim 2 wherein the upstream and downstream flanges define recesses to accommodate the link members.

4. The apparatus according to claim 3 wherein the recesses extend along a central portion of the upstream and downstream flanges, respectively.

5. The apparatus according to claim 4 further comprising:

(a) a second upstream radial flange formed on a low pressure compressor casing and adapted to be attached to the upstream flange of the outer casing, the second upstream flange defining support means to rotatably support an upstream end of the control shaft; and, (b) a second downstream flange formed on a diffuser casing and adapted to be attached to the downstream flange of the outer casing, the second downstream flange defining support means to rotatably support a downstream end of the control shaft.

6. The apparatus according to claim 3 further comprising:

(a) a second upstream radial flange formed on a low pressure compressor casing and adapted to be attached to the upstream flange of the outer casing, the second upstream flange defining support means to rotatably support an upstream end of the control shaft; and, (b) a second downstream flange formed on a diffuser casing and adapted to be attached to the downstream flange of the outer casing, the second downstream flange defining support means to rotatably support a downstream end of the control shaft.

7. The apparatus according to claim 1 wherein the control means comprises:

(a) an actuating cylinder having an extendable and contractible piston rod; and, (b) lever means attached to the piston rod and to the control shaft.

8. The apparatus according to claim 7 wherein the control means further comprises:

(a) means to sense at least one operational parameter of the turbojet engine and to generate at least one input signal; and, (b) computer means to receive the at least one input signal and to generate a control signal to control the actuating cylinder.

9. The apparatus according to claim 7 wherein the control means further comprises sensor means to measure the actual clearance between the segments and the rotor, and to generate a control signal to control the actuating cylinder.

10. The apparatus according to claim 1 wherein the control means comprises:

(a) a single actuating cylinder having an extendable and contractible piston rod; and, (b) synchronizing ring means connecting the piston rod to a plurality of control shafts.

11. The apparatus according to claim 10 wherein the control means further comprises:

(a) means to sense at least one operational parameter of the turbojet engine and to generate at least one input signal; and, (b) computer means to receive the at least one input signal and to generate a control signal to control the actuating cylinder.

12. The apparatus according to claim 10 wherein the control means further comprises sensor means to increase the actual clearance between the segments and the rotor and to generate a control signal to control the actuating cylinder.

* * * * *

UNITED STATES PATENT AND TRADEMARK OFFICE

CERTIFICATE OF CORRECTION

PATENT NO. : 4,714,404

DATED : December 22, 1987

INVENTOR(S) : LARDELLIER, Alain M.J.

It is certified that error appears in the above—identified patent and that said Letters Patent is hereby corrected as shown below:

Col. 3, line 9, "trapped from" should be --tapped from--.

Col. 5, line 12, "abaout" should be --about--.

IN THE TITLE:

Change "TUBROJET" to --TURBOJET--.

Signed and Sealed this

Thirty-first Day of May, 1988

*Attest:*

*Attesting Officer*

DONALD J. QUIGG

*Commissioner of Patents and Trademarks*